US011767629B2

(12) United States Patent
Choi et al.

(10) Patent No.: US 11,767,629 B2
(45) Date of Patent: Sep. 26, 2023

(54) WASHING MACHINE

(71) Applicant: LG Electronics Inc., Seoul (KR)

(72) Inventors: Yicheol Choi, Seoul (KR); Ilyoung Park, Seoul (KR); Sanghyun Joo, Seoul (KR); Jangseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/557,955

(22) Filed: Dec. 21, 2021

(65) Prior Publication Data

US 2022/0235510 A1 Jul. 28, 2022

(30) Foreign Application Priority Data

Jan. 25, 2021 (KR) ..... 10-2021-0010330

(51) Int. Cl.
*D06F 37/30* (2020.01)
*D06F 37/04* (2006.01)
*D06F 39/12* (2006.01)

(52) U.S. Cl.
CPC ..... *D06F 37/304* (2013.01); *D06F 37/04* (2013.01); *D06F 39/12* (2013.01)

(58) Field of Classification Search
CPC ..... D06F 37/304
See application file for complete search history.

(56) References Cited

U.S. PATENT DOCUMENTS

| | | | |
|---|---|---|---|
| 6,474,115 | B1 | 11/2002 | Preston et al. |
| 2004/0020510 | A1 | 2/2004 | Roseen |
| 2007/0277562 | A1 | 12/2007 | Uhlin |

FOREIGN PATENT DOCUMENTS

| | | |
|---|---|---|
| GB | 2141232 | 12/1984 |
| KR | 20010096995 | 11/2001 |
| KR | 20140123941 | 10/2014 |
| KR | 20200002758 | 1/2020 |
| WO | WO2000063483 | 10/2000 |

OTHER PUBLICATIONS

Extended European Search Report in European Appln. No. 21214705.2, dated Apr. 28, 2022, 6 pages.
International Search Report in International Appln. No. PCT/KR2021/018919, dated Apr. 28, 2022., 9 pages.

*Primary Examiner* — Jason Y Ko
(74) *Attorney, Agent, or Firm* — Fish & Richardson P.C.

(57) ABSTRACT

A washing machine is configured to perform washing using carbon dioxide and includes a first housing that defines an inner space and an opening, a drum disposed in the inner space of the first housing and configured to accommodate laundry, a barrier that covers the opening of the first housing and is coupled to the first housing, a second housing that covers a surface of the barrier and is coupled to the first housing, and a motor assembly coupled to the barrier. The motor assembly includes a stator, a rotor configured to rotate the drum, a bearing housing, a rotary shaft disposed in the bearing housing, the rotary shaft having a first end coupled to the rotor and a second end coupled to the drum, and a first sealing part and a second sealing part that are disposed in the bearing housing and coupled to the rotary shaft.

20 Claims, 21 Drawing Sheets

WASHING MACHINE

CROSS-REFERENCE TO RELATED APPLICATIONS

This application claims the benefit of Korean Patent Application No. 10-2021-0010330, filed on Jan. 25, 2021, which is hereby incorporated by reference as if fully set forth herein.

TECHNICAL FIELD

The present disclosure relates to a washing machine, and more particularly to a washing machine configured to perform laundry treatment such as washing using carbon dioxide ($CO_2$).

BACKGROUND

A washing machine may perform a washing procedure and a rinsing procedure using carbon dioxide ($CO_2$). For example, a washing tub of the washing machine may receive gaseous carbon dioxide ($CO_2$) and liquid carbon dioxide ($CO_2$) for washing or rinsing laundry. In order to wash laundry using carbon dioxide ($CO_2$), carbon dioxide ($CO_2$) may flow from a storage tub into the washing machine so that the inside of the washing machine can be filled with the carbon dioxide ($CO_2$). After completion of the washing procedure, carbon dioxide ($CO_2$) may be drained from the washing tub to a distillation tub and then flow from the distillation tub into the storage tub, so that the carbon dioxide ($CO_2$) can be reused. In some cases, the washing tub may be designed in a manner that a pulley is connected to a drive shaft, and a motor pulley is connected to a drum pulley through a belt, so that a drum can rotate by the washing tub.

In some cases, a washing space in which laundry is disposed and a motor space in which a motor is installed are used together without distinction therebetween, where the motor space may also be filled with carbon dioxide ($CO_2$). As a result, the amount of carbon dioxide ($CO_2$) to be used in the washing procedure of laundry may increase. In some cases, due to the large amount of carbon dioxide ($CO_2$), pressure vessels related to carbon dioxide ($CO_2$) may increase in size, and the system may become large and heavy, which may put restrictions on the space in which the system is to be installed. In some cases, the drum may not be taken out of the washing space, and it may be difficult to provide an operator (or a repairman) with a repair environment in which the drum can be repaired.

In some cases, the inside of a washing tub may be compressed and/or decompressed during operation of the washing machine, and the driving system may repeatedly perform such compression and decompression. In some cases, fat-soluble carbon dioxide may repeatedly infiltrate a bearing and discharge from the bearing. In some cases, grease applied to the bearing for lubrication may discharge or leak together with carbon dioxide. Repeated loss of grease may deteriorate the lubrication function of the bearing and may lead to reduction in reliability of the driving system.

SUMMARY

The present disclosure describes a washing machine that includes a structure that can block carbon dioxide from penetrating into a bearing that rotatably supports a rotary shaft.

The present disclosure further describes a washing machine that can help to prevent a change in pressure from being transferred to the driving system when pressure inside the washing machine is changed.

The present disclosure further describes a washing machine capable of reducing environmental pollution by reducing the amount of carbon dioxide ($CO_2$) used for laundry treatment such as washing.

The present disclosure further describes a washing machine capable of reducing the size of a pressure vessel designed to use carbon dioxide ($CO_2$) by reducing the amount of the carbon dioxide ($CO_2$) to be used.

The present disclosure further describes a washing machine capable of providing the environment in which an operator (or a repairman) can repair the drum that rotates while accommodating laundry.

The present disclosure further describes a washing machine capable of reducing the size of a space to be occupied by a motor assembly rotating the drum, thereby reducing the size of an overall space to be occupied by the washing machine.

The present disclosure further describes a washing machine capable of stably operating by allowing a washing space including the drum and a motor space including the motor to be kept at the same pressure.

In some implementations, the driving system can be disposed in a dead space inside a housing of the washing tub, and a bearing chamber unrelated to a change in internal pressure of the housing can be provided to help prevent the lubrication function of the bearing from being deteriorated so that the reliability of the driving system can be guaranteed, and a compact washing tub can be implemented through a simple structure.

In some implementations, the bearing chamber can define a pressure chamber, where shaft sealing can be provided to the outer surface of the bearing, and a communication hole can be defined to communicate with the housing that provides pressure to the inside of the bearing chamber. In some examples, a check valve can be provided in the communication hole.

The driving system can include at least one bearing or at least two bearings, at least two shaft seals, a bearing housing having a pressure communication hole communicating with the pressure of the washing tub, a check valve allowing only one-way flow within the pressure communication hole, a shaft, and the like.

In some examples, an outer surface of the shaft seal can be made of an elastic material such as rubber. Since an inner surface of the shaft seal can rub against the shaft, the inner surface of the shaft seal can be made of an engineering plastic material.

In some implementations, the washing machine can include a barrier for dividing the inner space of a washing tub into a washing unit and a motor unit such that liquid carbon dioxide used as a washing solvent is not transferred to the motor unit by the barrier. The barrier can be formed as a detachable (or separable) component. In addition, the motor can be directly mounted to a rotary shaft of a washing drum to minimize a space for installing the motor unit, so that the amount of carbon dioxide to be used for laundry treatment can be reduced. As a result, a distillation tank and the storage tank can be miniaturized in size, so that the overall size of the washing machine can be reduced.

In some implementations, a through-hole can be defined at an upper portion of the barrier, where the pipe of the heat exchanger disposed at the barrier can penetrate the through-hole. As a result, gaseous carbon dioxide can move to the washing unit and the motor unit to thereby provide pressure equilibrium between the washing unit and the motor unit.

According to one aspect of the subject matter described in this application, a washing machine includes a first housing that defines an inner space and an opening, a drum disposed in the inner space of the first housing and configured to accommodate laundry, a barrier that covers the opening of the first housing and is coupled to the first housing, a second housing that covers a surface of the barrier and is coupled to the first housing, and a motor assembly coupled to the barrier. The motor assembly includes a stator, a rotor configured to rotate the drum, a bearing housing, a rotary shaft disposed in the bearing housing, and a first sealing part and a second sealing part that are disposed in the bearing housing and coupled to the rotary shaft. The rotary shaft has a first end coupled to the rotor and a second end coupled to the drum. The washing machine is configured to perform washing using carbon dioxide supplied into the drum.

Implementations according to this aspect can include one or more of the following features. For example, the first sealing part and the second sealing part can be spaced apart from each other in an axial direction of the rotary shaft. In some examples, at least one of the first sealing part or the second sealing part can include a shaft seal that contacts and surrounds an outer circumferential surface of the rotary shaft. In some examples, at least one of the first sealing part or the second sealing part can include a plurality of shaft seals that contact and surround an outer circumferential surface of the rotary shaft.

In some implementations, the motor assembly can include a first bearing and a second bearing that are disposed between the first sealing part and the second sealing part and rotatably support the rotary shaft. In some examples, the first sealing part, the first bearing, the second bearing, and the second sealing part partition an inner space of the bearing housing into a plurality of spaces. For instance, the plurality of spaces can include a first space that is defined by the first sealing part, the rotary shaft, the first bearing, and the bearing housing, a second space that is defined by the first bearing, the rotary shaft, the second bearing, and the bearing housing, and a third space that is defined by the second bearing, the rotary shaft, the second sealing part, and the bearing housing.

In some examples, the bearing housing can define a communication hole configured to introduce air into the second space or discharge air out of the second space. In some examples, the motor assembly can include a check valve disposed in the communication hole. In some examples, the rotary shaft can define a flow passage that connects the second space to a center portion of the rotary shaft. In some examples, the rotary shaft further defines a connection flow passage at the center portion of the rotary shaft, the connection flow passage extending along an axial direction of the rotary shaft.

In some implementations, the rotary shaft can further define a first flow passage that connects the connection flow passage to the first space, where the flow passage is a second flow passage of the rotary shaft that connects the connection flow passage to the second space. In some examples, the rotary shaft can further define a third flow passage that connects the connection flow passage to the third space.

In some implementations, the rotary shaft can define a plurality of flow passages that include a connection flow passage that passes through an inside of the rotary shaft along a rotation axis of the rotary shaft. In some examples, the plurality of flow passages can further include a first flow passage that radially extends from the connection flow passage to the first space, a second flow passage of the rotary shaft that radially extends from the connection flow passage to the second space, and a third flow passage that radially extends from the connection flow passage to the third space. In some examples, the plurality of flow passages can be configured to communicate air to thereby maintain an equal pressure in the first space, the second space, and the third space.

In some implementations, the barrier can define (i) a first housing space between the first housing and the barrier and (ii) a second housing space between the second housing and the barrier, where the barrier is configured to block liquid carbon dioxide injected into the first housing space from leaking into the second housing space. In some examples, the motor assembly can pass through the barrier and be disposed in the first housing space and the second housing space. In some examples, the rotor can be disposed in the second housing space, and the rotary shaft can extend from the first housing space to the second housing space through the barrier.

In some implementations, the first sealing part can include a first sealing ring that surrounds a first portion of an outer circumferential surface of the rotary shaft, and the second sealing part can include a second sealing ring that is spaced apart from the first sealing ring in an axial direction of the rotary shaft and surrounds a second portion of the outer circumferential surface of the rotary shaft. In some examples, the first sealing part can include a first shaft-seal housing that accommodates the first sealing ring, and the second sealing part can include a second shaft-seal housing that accommodates the second sealing ring, where each of the first shaft-seal housing and the second shaft-seal housing radially extends to an inner surface of the bearing housing and is in contact with the rotary shaft and the inner surface of the bearing housing.

In some example, the opening of the first housing can be larger in size than a cross-section of the drum. For example, the opening can be larger in size than a maximum cross-section of the drum. The opening can be larger in size than a maximum cross-section of a space of the first housing. The opening can be maintained at the same size until reaching a center portion of the first housing.

In some implementations, the first housing can include a first flange formed along the opening, and the second housing can include a second flange coupled to the first flange. In some examples, the first flange can define at least one seating groove that is coupled to the barrier and extends along the opening.

In some examples, the first flange can include a first seating surface that further extends in a radial direction than a circumference of the seating groove. The second flange can include a second seating surface that is coupled to the first seating surface through surface contact with the first seating surface.

In some implementation, the barrier can include a first through-hole through which a rotary shaft of a motor passes, and a second through-hole through which gaseous carbon dioxide moves. In some examples, the second through-hole can be disposed higher than the first through-hole.

In some implementations, the washing machine can further include a heat exchanger coupled to the barrier, wherein a refrigerant pipe through which a refrigerant moves in the heat exchanger passes through the second through-hole. In some examples, the second through-hole can include two separate holes. In some examples, the barrier can be provided with a heat exchanger through which a refrigerant moves, wherein the heat exchanger is disposed in a space formed by the first housing and the barrier. In some examples, a heat insulation member can be disposed between the heat exchanger and the barrier. In some implementations, the heat exchanger can include a bracket coupled to the barrier, and the bracket can be fixed to the barrier by a bolt penetrating the barrier and a cap nut coupled to the bolt.

In some examples, the washing machine can further include a sealing part disposed around the rotary shaft and exposed to a space provided by the first housing and the barrier. The sealing part can help to prevent liquid carbon dioxide from flowing into a space opposite to the barrier.

In some examples, the bearing housing can include a communication hole through which inflow or outflow of external air is possible.

The rotary shaft can include a first flow passage and a second flow passage that are spaced apart from each other and enable inflow or outflow of air through the first flow passage and the second flow passage. In some examples, the first flow passage and the second flow passage can extend in a radial direction from a center portion of the rotary shaft. In some examples, the washing machine can further include a connection flow passage that interconnects the first flow passage and the second flow passage. For example, the connection flow passage can be disposed at a center of rotation of the rotary shaft, and is perpendicularly connected to each of the first flow passage and the second flow passage.

In some implementations, an O-ring can be disposed at a portion where the bearing housing is coupled to the barrier. The O-ring can help prevent liquid carbon dioxide from flowing into a space opposite to the barrier. In some implementations, an O-ring cover can be coupled to the O-ring to help to prevent separation of the O-ring from the barrier or the bearing housing.

In some implementations, the washing machine can further include a storage tank configured to store carbon dioxide to be supplied to the drum. The washing machine can further include a distillation chamber configured to distill liquid carbon dioxide used in the drum. The washing machine can further include a filter configured to filter contaminants when discharging liquid carbon dioxide used in the drum. The washing machine can further include a compressor configured to reduce pressure inside the drum.

In some implementations, the first housing and the second housing can be interconnected to form a closed space, wherein the closed space is divided by the barrier.

DETAILED DESCRIPTION

Figure 1:
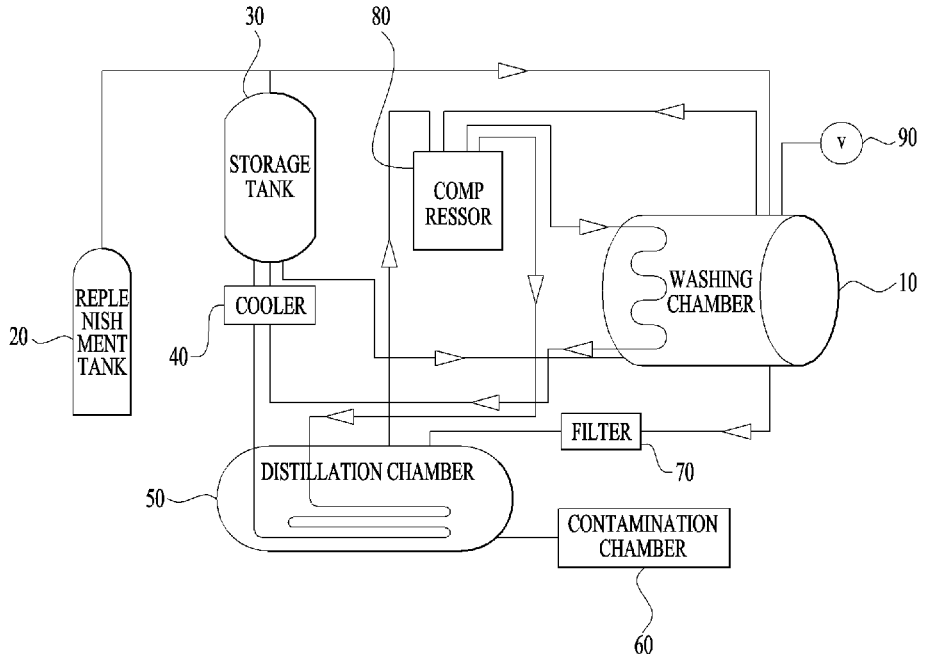
FIG. 1 is a conceptual diagram illustrating an example of a washing machine.

FIG. 1 is a conceptual diagram illustrating an example of a washing machine.

In some implementations, referring to FIG. 1, the washing machine can perform various laundry treatments (such as washing, rinsing, etc. of laundry) using carbon dioxide ($CO_2$), and the washing machine can include elements capable of storing or processing carbon dioxide ($CO_2$).

For instance, the washing machine can include a supply unit for supplying carbon dioxide, a washing unit for processing laundry, and a recycling unit for processing used carbon dioxide. The supply unit can include a tank for storing liquid carbon dioxide therein, and a compressor for liquefying gaseous carbon dioxide. In some examples, the tank can include a supplementary tank and a storage tank. The washing unit can include a washing chamber into which carbon dioxide and laundry can be put together. The recycling unit can include a filter for separating contaminants dissolved in liquid carbon dioxide after completion of the washing procedure, a cooler for liquefying gaseous carbon dioxide, a distillation chamber for separating contaminants dissolved in the liquid carbon dioxide, and a contamination chamber for storing the separated contaminants after distillation.

The supplementary tank 20 can store carbon dioxide to be supplied to the washing chamber 10. In some examples, the supplementary tank 20 can be a storage tank that can be used when replenishment of carbon dioxide is performed. In some examples, the supplementary tank 20 may not be installed in the washing machine in a situation where replenishment of such carbon dioxide is not performed. In some examples, the supplementary tank may not be provided in a normal situation, and the supplementary tank may be coupled to supplement carbon dioxide as needed, so that replenishment of carbon dioxide is performed. In some implementations, when such replenishment of carbon dioxide is completed, the supplementary tank can be separated from the washing machine.

The storage tank 30 can supply carbon dioxide to the washing chamber 10, and can store the carbon dioxide recovered through the distillation chamber 50. The cooler 40 can re-liquefy gaseous carbon dioxide, and can store the liquid carbon dioxide in the storage tank 30. The distillation chamber 50 can distill liquid carbon dioxide used in the washing chamber 10. The distillation chamber 50 can separate contaminants by vaporizing the carbon dioxide through the distillation process, and can remove the separated contaminants.

In some implementations, the compressor 80 can reduce pressure of the inside of the pressurized washing chamber 10 to approximately 1.5 bar. The contamination chamber 60 can store contaminants filtered through distillation by the distillation chamber 50. The filter unit 70 can filter out contaminants in the process of discharging liquid carbon dioxide used in the washing chamber 10 into the distillation chamber 50. The filter unit 70 can include a filter having a plurality of fine holes.

Laundry is put in the washing chamber 10, so that washing or rinsing of the laundry is performed. When a valve of the storage tank 30 connected to the washing chamber 10 opens a flow passage, air pressure in the washing chamber 10 becomes similar to air pressure in the storage tank 30. For example, gaseous carbon dioxide is injected first, and then the inside of the washing chamber 10 is pressurized through equipment such as a pump, so that the inside of the washing chamber 10 can be filled with liquid carbon dioxide. In a situation in which the inside of the washing chamber 10 is maintained at approximately 45~51 bar and 10~15° C., washing can be performed for 10~15 minutes, and rinsing can be performed for 3-4 minutes. When washing or rinsing is completed, liquid carbon dioxide is discharged from the washing chamber 10 to the distillation chamber 50.

The valve 90 can remove internal air of the washing chamber 10 before starting the washing procedure, thereby helping to prevent moisture from freezing in the washing chamber 10. Because washing performance is deteriorated when moisture in the washing chamber 10 is frozen, moisture in the washing chamber 10 can be prevented from being frozen.

Figure 2:
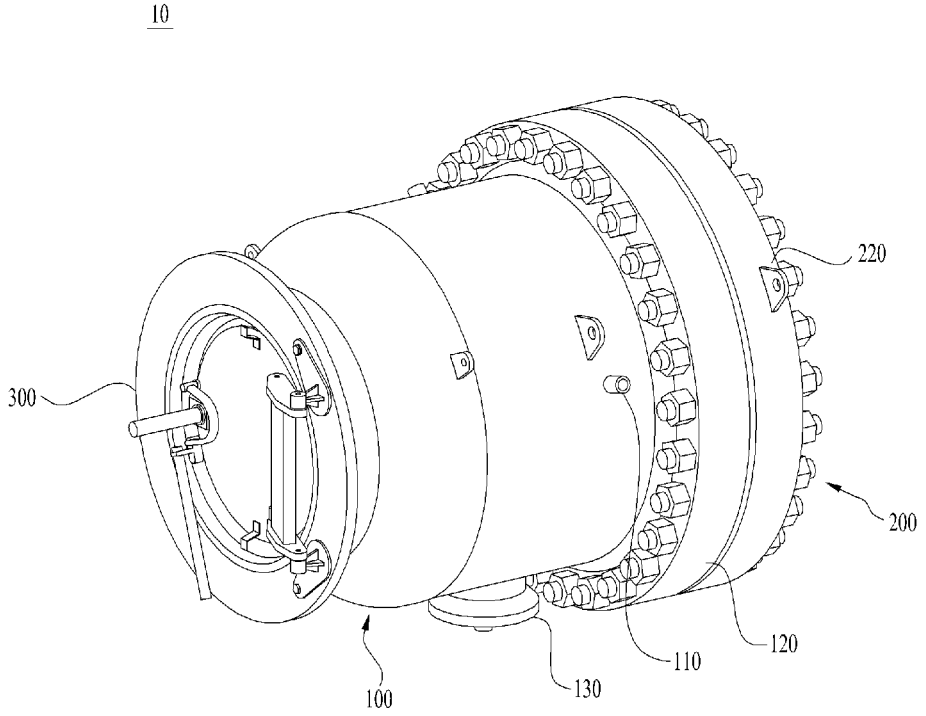
FIG. 2 illustrates an example of a washing chamber.
Figure 3:
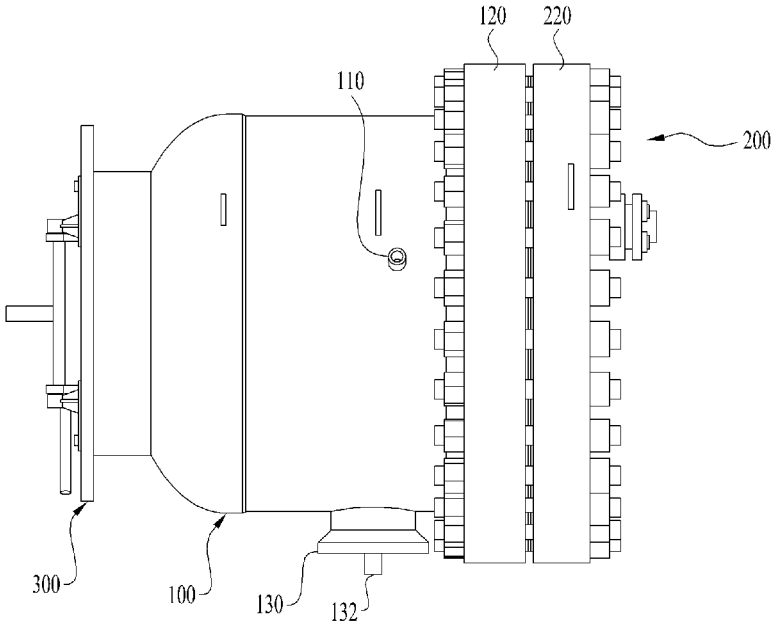
FIG. 3 is a front view illustrating the structure shown in FIG. 2.
Figure 4:
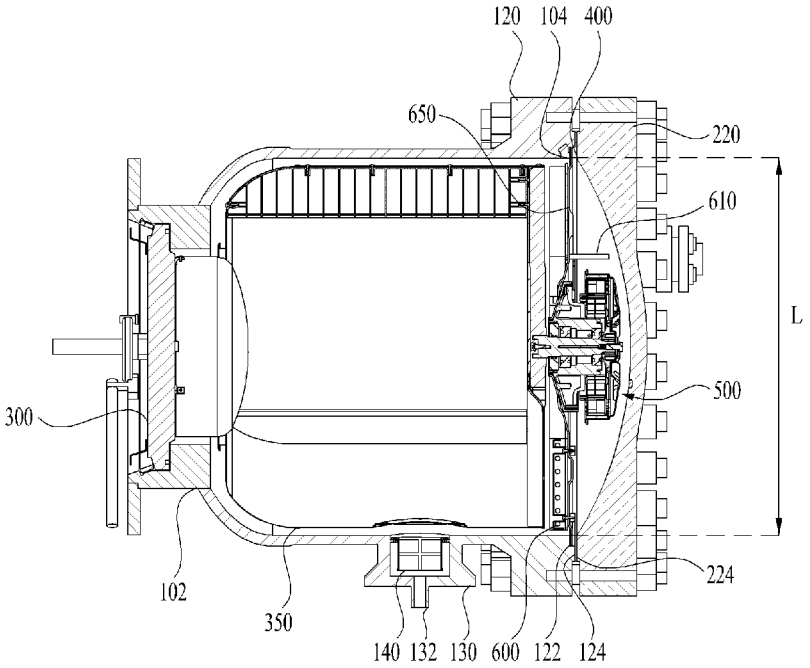
FIG. 4 is a cross-sectional view illustrating the structure shown in FIG. 2.

FIG. 2 illustrates an example of the washing chamber. FIG. 3 is a front view illustrating the structure shown in FIG. 2. FIG. 4 is a cross-sectional view illustrating the structure shown in FIG. 2.

Referring to FIGS. 2 to 4, the washing chamber 10 can include a door 300, a first housing 100, and a second housing. In this case, the washing chamber 10 can refer to a space in which laundry is disposed and various laundry treatments such as washing, rinsing, etc. of laundry can be performed. In addition, the washing chamber 10 can be provided with a motor assembly that supplies driving force capable of rotating the drum to the washing chamber 10.

The door 300 can be provided at one side of the first housing 100 to open and close the inlet 102 provided in the first housing 100. When the door 300 opens the inlet 102, the user can put laundry to be treated into the first housing 100 or can take the completed laundry out of the first housing 100.

The first housing 100 can include a space in which the drum 350 accommodating laundry is inserted. The drum 350 is rotatably provided so that liquid carbon dioxide and laundry are mixed together in a state in which laundry is disposed in the drum 350.

The first housing 100 can have an opening 104 in addition to the inlet 102. The opening 104 can be located opposite to the inlet 102, and can be larger in size than the inlet 102.

The first housing 100 can be formed in an overall cylindrical shape, the inlet 102 formed in a circular shape can be formed at one side of the first housing 100, and the opening 104 formed in a circular shape can be provided at the other side of the first housing 100.

The drum 350 can be formed in a cylindrical shape similar to the shape of the inner space of the first housing 100, so that the drum 350 can rotate clockwise or counterclockwise in the first housing 100.

The opening 104 can be larger in size than the cross-section of the drum 350, so that the operator or user can repair the drum by removing the drum 350 through the opening 104. In this case, the opening 104 can be larger in size than a maximum cross-section of the drum 350. Therefore, the operator or the user can open the opening 104 to remove the drum 350. It is also possible to install the drum 350 in the first housing 100 through the opening 104.

The opening 104 can be larger in size than the maximum cross-section of the space of the first housing 100. In addition, the opening 104 can be maintained at the same size while extending to the center portion of the first housing 100. Thus, when the operator or the user removes the drum 350 from the first housing 100 or inserts the drum 350 into the first housing 100, a space sufficient not to interfere with movement of the drum 350 can be guaranteed.

In some examples, the user can put laundry into the first housing 100 using the inlet 102, and maintenance or assembly of the drum 350 can be achieved using the opening 104. The inlet 102 and the opening 104 can be located opposite to each other in the first housing 100.

The first housing 100 can be provided with an inlet pipe 110 through which carbon dioxide flows into the first housing 100. The inlet pipe 110 can be a pipe that is exposed outside the first housing 100, so that the pipe through which carbon dioxide flows can be coupled to the elements described in FIG. 1.

The first housing 100 can be provided with the filter fixing part 130 capable of fixing the filter unit 70. The filter fixing part 130 can be formed to radially protrude from the cylindrical shape of the first housing 100, resulting in formation of a space in which the filter can be inserted. The filter fixing part 130 can be provided with a discharge pipe 132 through which carbon dioxide filtered through the filter unit 70 can be discharged from the first housing 100. The carbon dioxide used in the first housing 100 can be discharged outside the first housing 100 through the discharge pipe 132.

The first housing 100 can include a first flange 120 formed along the opening 104. The first flange 120 can extend in a radial direction along the outer circumferential surface of the first housing 100 in a similar way to the cylindrical shape of the first housing 100. The first flange 120 can be evenly disposed along the circumference of the first housing 100 in a direction in which the radius of the first housing 100 increases.

The second housing 200 can be coupled to the first housing 100 to form one washing chamber. For example, the washing chamber can provide a space in which laundry treatment is performed and a space in which a motor assembly for providing driving force to rotate the drum is installed.

The second housing 200 can include a second flange 220 coupled to the first flange 120. The second housing 200 can be formed to have a size similar to the cross-section of the first housing 100, and can be disposed at the rear of the first housing 100.

The second flange 220 can be coupled to the first flange 120 by a plurality of bolts, so that the internal pressure of the washing chamber can be maintained at pressure greater than the external atmospheric pressure in a state in which the second housing 200 is fixed to the first housing 100.

The first filter fixing part 130 provided in the first housing 100 can be provided with a filter 140 for filtering foreign substances. The filter 140 can include a plurality of small holes not passing foreign substances, but liquid carbon dioxide can pass through the small holes, so that the liquid carbon dioxide can be discharged outside the first housing 100 through the discharge pipe 132.

In some examples, a barrier 400 for sealing the opening 104 while coupling to the first housing 100 can be provided. The second housing 200 can seal one surface of the barrier 400.

In the left space on the basis of the barrier 400 in the structure shown in FIG. 4, the drum 350 can be disposed so that laundry and liquid carbon dioxide are mixed together and laundry treatment such as washing or rising can be performed in the drum 350. On the other hand, the motor assembly 500 can be disposed in the right space on the basis of the barrier 400, thereby providing driving force capable of rotating the drum 350. In this case, a portion of the motor assembly 500 can be coupled to the drum 350 after passing through the barrier 400.

The barrier 400 can be larger in size than the opening 104, and can be in contact with the opening 104, thereby sealing the opening 104. The barrier 400 and the opening 104 can be formed to have a substantially circular shape similar to the shape of the first housing 100, and the diameter L of the opening 104 can be smaller than the diameter of the barrier 400. The diameter L of the opening 104 can be larger than the diameter of the drum 350. Therefore, the cross-section of the drum 350 can be formed to have the smallest size, the cross-section of the opening 104 can be formed to have a medium size, and the barrier 400 can be formed to have the largest size.

The barrier 400 can be arranged to have a plurality of steps, thereby guaranteeing a sufficient strength.

The first flange 120 can be provided with a seating groove 122 coupled to the barrier 400 so that the seating groove 122 can be formed along the opening 104. That is, the seating groove 122 can be provided at a portion extending in a radial direction from the opening 104. The seating groove 122 can be recessed by a thickness of the barrier 400 so that the first flange 120 and the second flange 220 are formed to contact each other. The seating groove 122 can be formed to have the same shape as the outer circumferential surface of the barrier 400. Thus, when the barrier 400 is seated in the seating groove 122, the surface of the first flange 120 becomes flat.

The first flange 120 can include the first seating surface 124 extending in a radial direction than the circumference of the seating groove 122, and the second flange 220 can include a second seating surface 224 coupled to the first seating surface 124 in surface contact with the first seating surface 124. The first seating surface 124 and the second seating surface 224 can be in contact with each other, so that carbon dioxide injected into the inner space of the first housing 100 can be prevented from being disposed outside the first housing 100. The first seating surface 124 and the second seating surface 224 can be in surface contact with each other while being disposed at the outer circumferential surfaces of the first housing 100 and the second housing 200, and at the same time can provide a coupling surface where two housings can be bolted to each other.

A heat exchanger 600 in which refrigerant flows can be disposed at the barrier 400. The heat exchanger 600 can be disposed in a space formed by the first housing 100 and the barrier 400. The heat exchanger 600 can change a temperature of the space formed by the first housing 100. The temperature of the space formed by the first housing 100 can be reduced so that humidity of the inner space of the first housing 100 can be lowered.

A heat insulation member (i.e., an insulation member) 650 can be disposed between the heat exchanger 600 and the barrier 400. The heat insulation member 650 can prevent the temperature of the heat exchanger 600 from being directly transferred to the barrier 400. The heat insulation member 650 can allow the barrier 400 to be less affected by temperature change of the heat exchanger 600. The heat insulation member 650 can be formed similar to the shape of the heat exchanger, thereby covering the entire surface of the heat exchanger 600.

Figure 5:
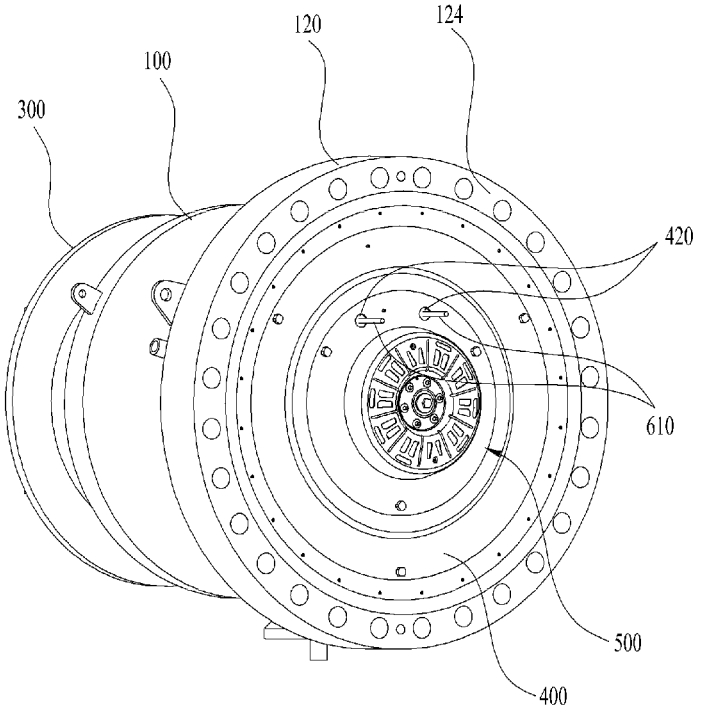
FIG. 5 is a diagram illustrating an example of a second housing separated from the structure shown in FIG. 2.
Figure 6:
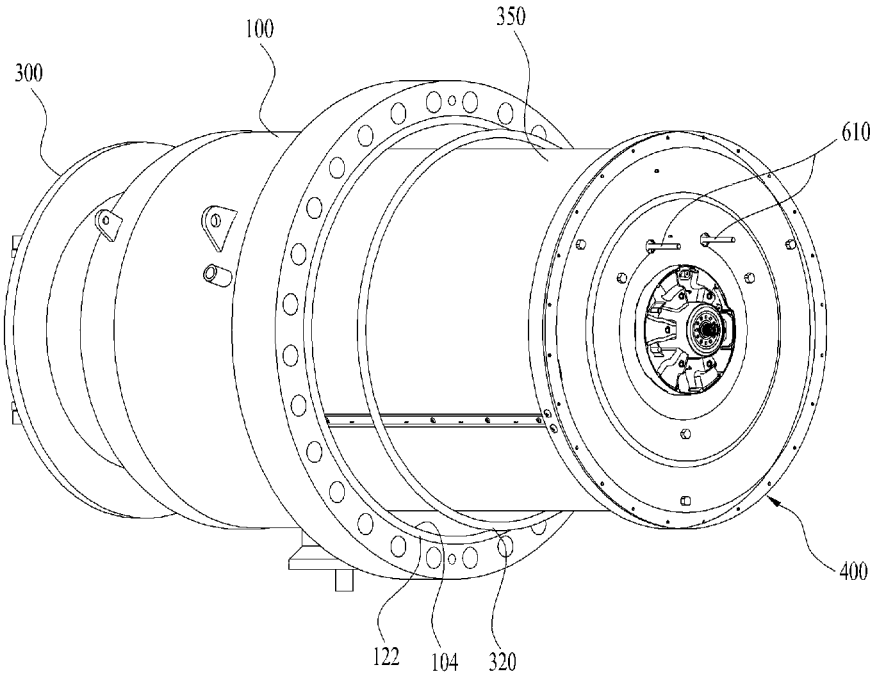
FIG. 6 is a diagram illustrating example parts of a drum shown in FIG. 5 that are detached rearward.

FIG. 5 is a diagram illustrating an example of a second housing that is separated from the structure shown in FIG. 2. FIG. 6 is a diagram illustrating some parts of the drum shown in FIG. 5 that are detached rearward.

Referring to FIGS. 5 and 6, when the second housing 200 is separated from the first housing 100, the barrier 400 can be exposed outside. Since the barrier 400 is coupled to the seating groove of the first housing 100, the inner space of the first housing is not exposed outside even when the second housing 200 is separated from the first housing 100. The barrier 400 can be coupled to the second housing 200 by a plurality of bolts or the like.

A motor assembly 500 can be coupled to the center portion of the barrier 400, and a second through-hole 420 can be formed at an upper side of the motor assembly 500. A refrigerant pipe 610 for circulating a refrigerant in the heat exchanger 600 can be formed to pass through the second through-hole 420.

When the barrier 400 is separated from the first housing 100, the opening 104 can be exposed outside. For example, the drum 350 can be withdrawn to the outside through the opening 104. As the opening 104 is larger in size than the drum 350, maintenance of the drum 350 is possible through the opening 104.

A gasket 320 can be disposed between the barrier 400 and the seating groove 122. As a result, when the barrier 400 is coupled to the first housing 100, carbon dioxide can be prevented from leaking between the barrier 400 and the first housing 100. When the barrier 400 is seated in the seating groove 122, the barrier 400 can be coupled to the first housing 100 by the plurality of bolts while compressing the gasket 320. A plurality of coupling holes through which the barrier 400 is coupled to the first housing 100 can be evenly disposed along the outer circumferential surface of the barrier 400.

Figure 7:
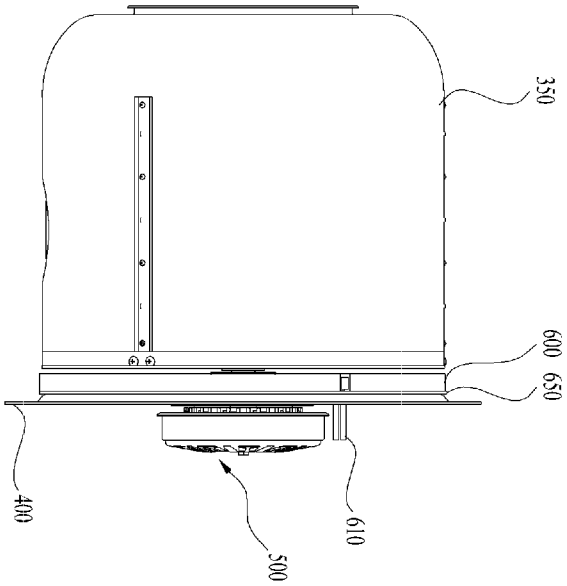
FIG. 7 is a diagram illustrating the drum and some example elements of the drum.
Figure 8:
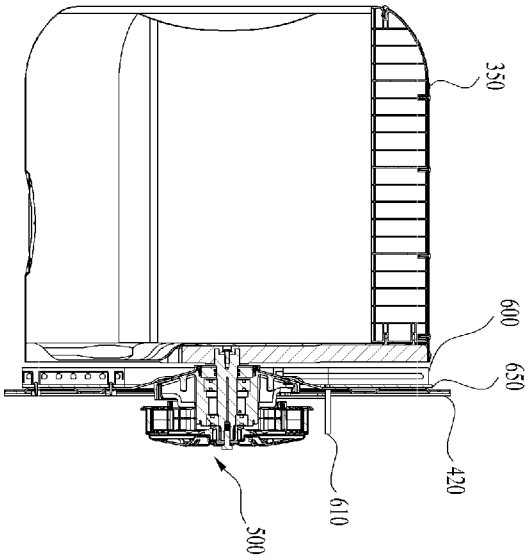
FIG. 8 is a cross-sectional view illustrating the structure shown in FIG. 7.
Figure 9:
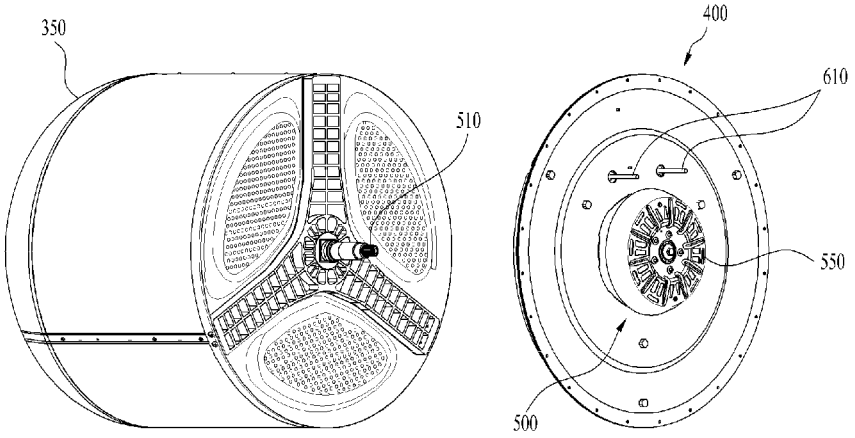
FIG. 9 is an exploded perspective view illustrating the structure shown in FIG. 7.
Figure 10:
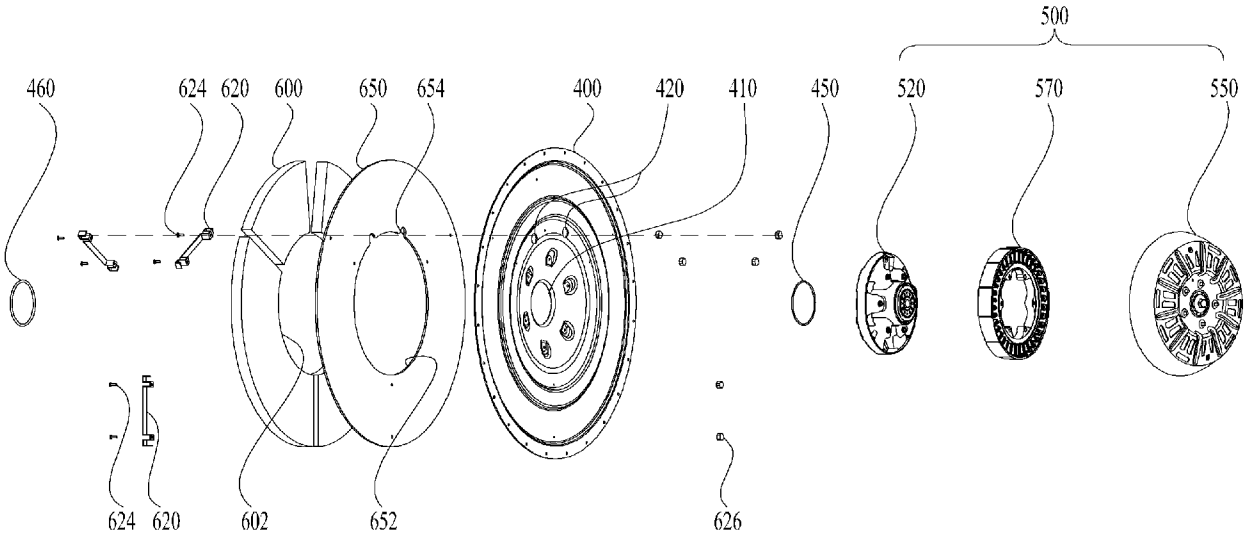
FIG. 10 is an exploded perspective view illustrating example elements of the structure shown in FIG. 7.

FIG. 7 is a diagram illustrating examples of a drum and some elements of the drum. FIG. 8 is a cross-sectional view illustrating the structure shown in FIG. 7. FIG. 9 is an exploded perspective view illustrating the structure shown in FIG. 7. FIG. 10 is an exploded perspective view illustrating example elements of the structure shown in FIG. 7.

As can be seen from FIGS. 7 and 8, the first housing 100 is removed so that the drum 350 is exposed outside. The drum 350 can be formed in a cylindrical shape such that laundry put into the drum 350 through the inlet 102 is movable into the drum 350.

In the left side from the barrier 400, the drum 350, the heat exchanger 600, and the heat insulation member 650 can be disposed. In the right side from the barrier 400, the motor assembly 500 can be disposed.

FIG. 9 is an exploded perspective view illustrating that the drum 350 and the barrier 400 are separated from each other. Referring to FIG. 9, the rotary shaft 510 of the motor assembly 500 can be coupled to the drum 350 at the rear of the drum 350. Therefore, when the rotary shaft 510 rotates, the drum 350 can also be rotated thereby. In addition, when the rotational direction of the rotary shaft 510 is changed, the rotational direction of the drum 350 is also changed.

Since the motor assembly 500 is coupled to the barrier 400, the driving force to rotate the drum 350 is not transmitted to the drum 350 through a separate belt or the like. As a result, in some examples, rotational force of the motor can be directly transmitted to the drum 350, so that loss of force or occurrence of noise can be reduced.

FIG. 10 is an exploded perspective view illustrating example elements installed at the barrier shown in FIG. 9.

Referring to FIG. 10, the heat exchanger 600 can be formed in a doughnut shape similar to the shape of the opening 104. A circular through-hole 602 can be formed at the center of the heat exchanger 600 so that the rotary shaft 510 of the motor can pass through the through-hole 602.

The heat insulation member 650 can be formed in a shape corresponding to the heat exchanger 600, and can prevent the temperature change generated in the heat exchanger 600 from being transferred to the barrier 400. The heat insulation member 650 can be made of a material having low thermal conductivity, and can be disposed between the heat exchanger 600 and the barrier 400. A circular through-hole 652 can be formed at the center of the heat insulation member 650 so that the rotary shaft 510 of the motor can pass through the through-hole 652.

The circular shape of the through-hole 602 of the heat exchanger 600 can be similar in size to the circular shape of the through-hole 652 of the heat insulation member 650. However, the through-hole 652 can include a through-groove 654 through which the refrigerant pipe 610 for supplying refrigerant to the heat exchanger 600 can pass.

The heat exchanger 600 can include a bracket 620 coupled to the barrier 400. The bracket 620 can be fixed to the barrier 400 by both a bolt 624 penetrating the barrier 400 and a cap nut 626 coupled to the bolt 624.

The bracket 620 can be formed in a three-dimensionally stepped shape such that the bracket 620 is disposed at a surface where the heat exchanger 600 has a thin thickness. The bolt 624 can be disposed at the stepped groove portion, and can be coupled to the cap nut 626.

The plurality of brackets 620 can be provided, so that the heat exchanger 600 and the heat insulation member 650 can be coupled to the barrier 400 at a plurality of points. FIG. 10 illustrates an example in which three brackets 620 are used for convenience of description. In other implementations, a larger number of brackets or a smaller number of brackets than the three brackets can also be used. The plurality of brackets can be evenly disposed at various positions of the heat exchanger 600, so that the heat exchanger 600 can be more stably fixed.

The motor assembly 500 can be coupled to the barrier 400. The motor assembly 500 can include a stator 570, a rotor 550, and a bearing housing 520. The bearing housing 520 can include the rotary shaft 510. One end of the rotary shaft 510 can be coupled to the rotor 550, and the other end of the rotary shaft 510 can be coupled to the drum 350. Therefore, as the rotor 550 rotates around the stator 570, the rotary shaft 510 is also rotated.

The stator 570 is fixed to a bearing housing 520, thereby providing the environment in which the rotor 550 can rotate.

When the bearing housing 520 is coupled to the barrier 400, an O-ring 450 can be disposed between the bearing housing 520 and the barrier 400, so that liquid carbon dioxide injected into the first housing 100 is prevented from flowing into a gap between the barrier 400 and the bearing housing 520. In some examples, an O-ring cover 460 can be disposed to improve the coupling force of the O-ring 450. The O-ring cover 460 can be formed similar in shape to the O-ring 450. The O-ring cover 460 can reduce the size of one surface where the O-ring 450 is exposed to one side of the barrier 400, thereby more strongly sealing the gap.

Figure 11A:
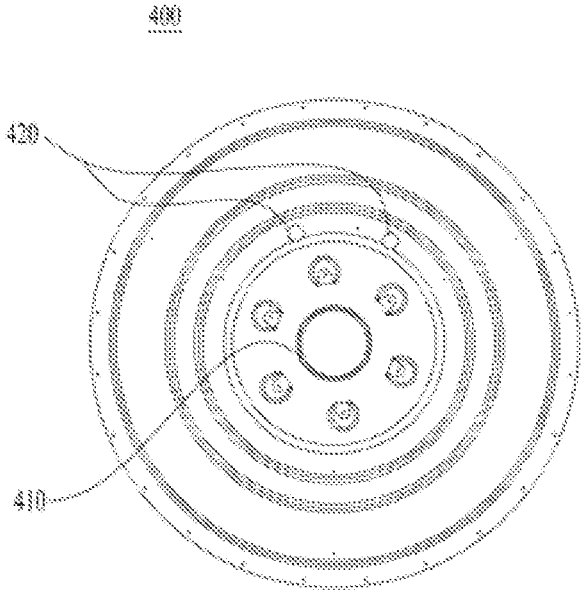
FIGS. 11A and 11B are diagrams illustrating an example of a barrier.
Figure 11B:
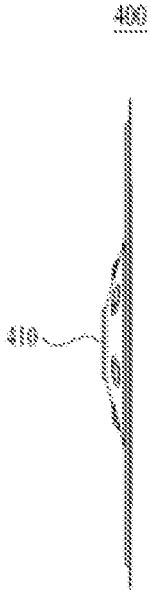

FIGS. 11A and 11B are diagrams illustrating the barrier 400. FIG. 11A is a front view of the barrier 400, and FIG. 11B is a side cross-sectional view of the center portion of the barrier 400.

As can be seen from the side cross-sectional view of the barrier 400, since the barrier 400 includes a plurality of step differences, the barrier 400 can provide sufficient strength by which the heat exchanger 600 can be fixed to one side of the barrier 400 and the motor assembly 500 can be fixed to the other side of the barrier 400.

A first through-hole 410 through which the rotary shaft 510 of the motor passes can be disposed at the center of the barrier 400. The first through-hole 410 can be formed in a circular shape, so that no contact occurs at the rotary shaft 510 passing through the first through-hole 410.

The barrier 400 can include a second through-hole 420 through which gaseous carbon dioxide moves. The second through-hole 420 can be disposed at a higher position than the first through-hole 410. The second through-hole 420 can be disposed to allow the refrigerant pipe 610 to pass therethrough. The second through-hole 420 can be larger in size than the first through-hole 410.

In some implementations, the second through-hole 420 can be implemented as two separate holes. The second through-holes 420 can be disposed symmetrical to each other with respect to the center point of the barrier 400.

The barrier 400 can be a single component capable of being separated from the first housing 100 or the second housing 200, and can provide a coupling structure between the heat exchanger 600 and the motor assembly 500.

In addition, when the barrier 400 is separated from the first housing 100, the environment in which the user or operator can separate the drum 350 from the first housing 100 can be provided.

The barrier 400 can be formed to have a plurality of step differences in a forward or backward direction, and can sufficiently increase the strength. In addition, the barrier 400 can be formed to have a curved surface within some sections, so that the barrier 400 can be formed to withstand force generated in various directions. The outermost portion of the barrier 400 can be coupled to the seating groove 122 of the first housing 100.

Referring to the direction from the outermost part of the barrier 400 to the center part of the barrier 400 as shown in FIG. 11B, the barrier 400 can be formed to have step differences in various directions (e.g., the barrier first protrudes to the left side, protrudes to the right side, and again protrudes to the left side) by various lengths, thereby increasing strength.

Figure 12:
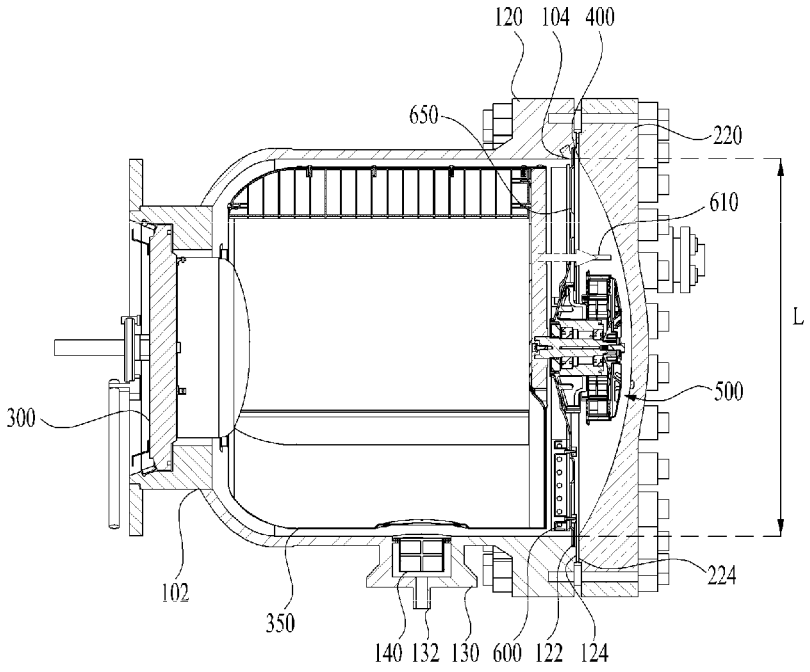
FIG. 12 is a diagram illustrating an example function of a second through-hole.

FIG. 12 is a diagram illustrating an example function of the second through-hole.

Referring to FIG. 12, carbon dioxide can be injected into the drum 350 to perform washing of laundry. In this case, the carbon dioxide can be a mixture of liquid carbon dioxide and gaseous carbon dioxide. Since the liquid carbon dioxide is heavier than the gaseous carbon dioxide, the liquid carbon dioxide can be located below the gaseous carbon dioxide, and the gaseous carbon dioxide can be present in the empty space located over the liquid carbon dioxide. By rotation of the drum 350, laundry disposed in the drum 350 can be mixed with liquid carbon dioxide.

The barrier 400 can prevent liquid carbon dioxide injected into the space formed by both the first housing 100 and the barrier 400 from flowing into the other space formed by both the second housing 200 and the barrier 400. That is, since the barrier 400 seals the opening 104, liquid carbon dioxide may not move to the opposite side of the barrier 400.

During laundry treatment such as washing, the space formed by the first housing 100 and the barrier 400 is separated from the space formed by the second housing 200 and the barrier 400. In this case, the space formed by the first housing 100 and the barrier 400 can be filled with liquid carbon dioxide and gaseous carbon dioxide at a higher pressure than atmospheric pressure. Therefore, in order to stably maintain the pressure of the washing chamber, only gaseous carbon dioxide rather than liquid carbon dioxide can move into the space formed by the second housing 200 and the barrier 400, resulting in implementation of pressure equilibrium.

For example, gaseous carbon dioxide can pass through the barrier 400 through the second through-hole 420 provided at the barrier 400. However, since the second through-hole 420 is located higher in height than the liquid carbon dioxide, the gaseous carbon dioxide may not move through the second through-hole 420.

Typically, the amount of liquid carbon dioxide used in washing or rising of laundry may not exceed half of the total capacity of the drum 350. In other words, the amount of liquid carbon dioxide does not exceed the height of the rotary shaft 510 coupled to the drum 350.

Therefore, if the second through-hole 420 is located higher than the rotary shaft 510, gaseous carbon dioxide may not move through the second through-hole 420. However, since the space formed by the first housing 100 and the barrier 400 is filled with gaseous carbon dioxide, the gaseous carbon dioxide can freely flow into the space formed by the second housing 200 and the barrier 400, resulting in implementation of pressure equilibrium.

That is, during laundry treatment such as washing or rinsing, gaseous carbon dioxide and liquid carbon dioxide can be mixed with each other in the space partitioned by the first housing 100 and the barrier 400. In some examples, where liquid carbon dioxide is not present in the space partitioned by the second housing 200 and the barrier 400, only gaseous carbon dioxide may be present in the space partitioned by the second housing 200 and the barrier 400. Since two spaces are in a pressure equilibrium state therebetween, liquid carbon dioxide may not be present in the space formed by the second housing 200 and the barrier 400, and the amount of used liquid carbon dioxide can be reduced in the space formed by the second housing 200 and the barrier 400. Therefore, the total amount of carbon dioxide to be used in washing or rinsing of laundry can be reduced, so that the amount of carbon dioxide to be used can be greatly reduced compared to the prior art. As a result, the amount of carbon dioxide to be reprocessed after use can also be reduced. As described above, the amount of carbon dioxide to be used can be reduced, so that a storage capacity of the tank configured to store carbon dioxide and the overall size of the washing machine configured to use carbon dioxide can also be reduced. In addition, since the amount of carbon dioxide to be reprocessed after use is reduced, the time for washing or rinsing can also be reduced.

Figure 13:
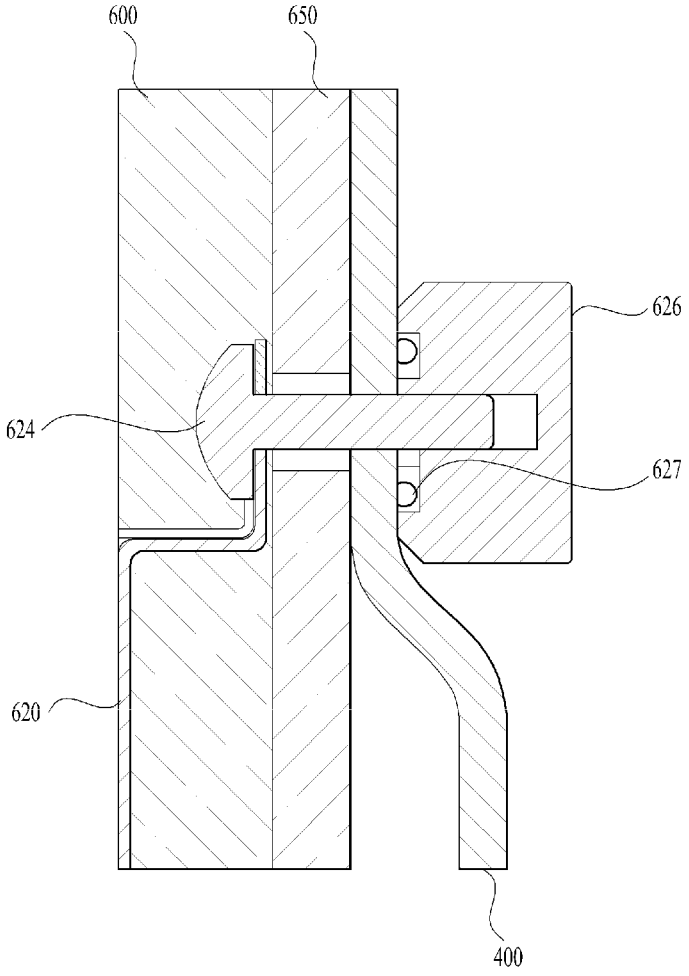
FIG. 13 is a diagram illustrating an example of a heat exchanger coupled to a barrier.

FIG. 13 is a diagram illustrating an example of a heat exchanger coupled to the barrier.

For example, FIG. 13 illustrates a cross-sectional view of a portion in which the bracket 620 is in contact with the heat exchanger 600.

The bracket 620 can be formed in a stepped shape, and the stepped portion is in contact with the heat exchanger 600, so that the heat exchanger 600 can be fixed. The protruding portion can be disposed to contact the heat insulation member 650.

The bolt 624 can be fixed to the protruding portion, and the bolt 624 can pass through the heat insulation member 650 and the barrier 400. A cap nut 626 can be provided at the opposite side of the bolt 624, so that the bolt 624 can be fixed by the cap nut 626. The cap nut 626 can be in contact with the plurality of points of the barrier 400, so that the fixing force at the barrier 400 can be guaranteed.

The cap nut 626 can be formed in a rectangular parallelepiped shape, and a coupling groove can be formed at a portion contacting the barrier 400. A sealing 627 can be disposed in the coupling groove to seal a gap when the cap nut 626 is coupled to the barrier 400. That is, when the cap nut 626 is coupled to the bolt 624, the sealing 627 is pressed so that the bolt 624 can be fixed while being strongly pressurized by the cap nut 626. For example, the barrier 400 is also pressed together, a hole through which the bolt 624 passes can be sealed.

The bracket 620 can be implemented as a plurality of brackets, so that the heat exchanger 600 can be fixed at various positions. Although the shape of the brackets 620 can be changed when viewed from each direction, the same method for coupling the bracket 620 by the bolt and the cap nut can be applied to the brackets 620.

Figure 14:
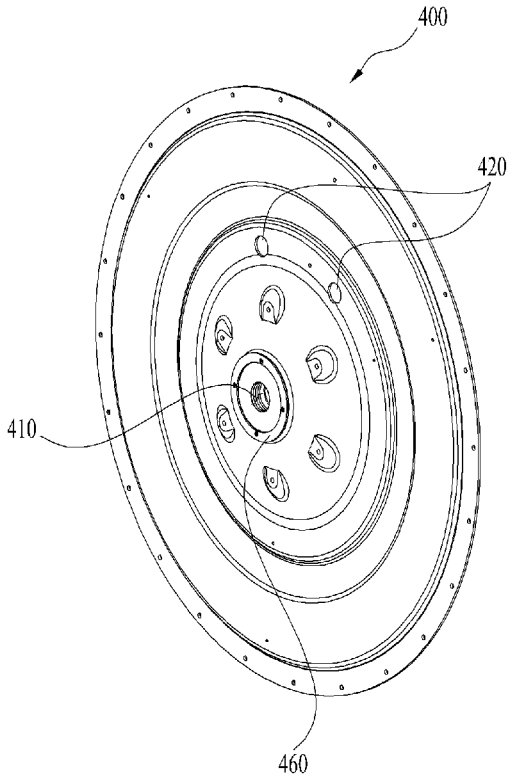
FIG. 14 is a diagram illustrating examples of an O-ring and an O-ring cover that are mounted to the barrier.
Figure 15:
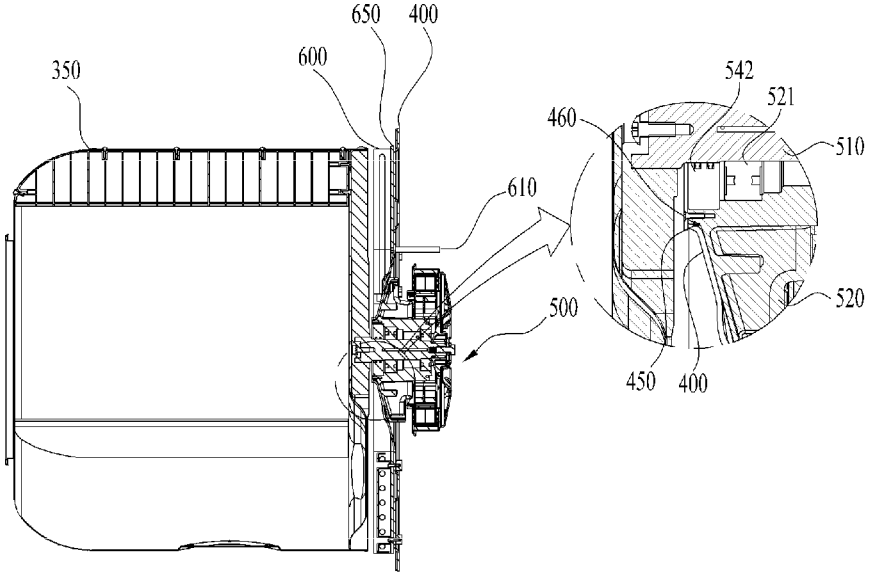
FIG. 15 is a diagram illustrating an example state in which the structure of FIG. 14 is coupled to other elements.

FIG. 14 is a diagram illustrating an example of an O-ring and an O-ring cover mounted to the barrier. FIG. 15 is a diagram illustrating an exemplary state in which the structure of FIG. 14 is coupled to other elements.

The O-ring 450 can be disposed at a portion where the bearing housing 520 is coupled to the barrier 400. The O-ring 450 can prevent liquid carbon dioxide from flowing into the space opposite to the barrier 400.

In some examples, where the rotary shaft 510 penetrates the first through-hole 410 of the barrier 400, the gap can exist in the first through-hole 410. Since the rotary shaft 510 rotates, the rotary shaft 510 can be spaced apart from the first through-hole 410 by a predetermined gap, and this predetermined gap may not be sealed. Therefore, the bearing housing 520 can be coupled to the barrier 400, and the gap between the bearing housing 520 and the barrier 400 is sealed by the O-ring 450, so that carbon dioxide can be prevented from moving through the gap sealed by the O-ring 450.

The O-ring 450 can be coupled to the O-ring cover 460 preventing separation of the O-ring 450. The O-ring cover 460 can surround one surface of the O-ring 450, so that the O-ring cover 460 can prevent the O-ring 450 from being exposed to a space provided by the first housing 100. Therefore, the O-ring cover 460 can prevent the O-ring 450 from being separated by back pressure.

Figure 16:
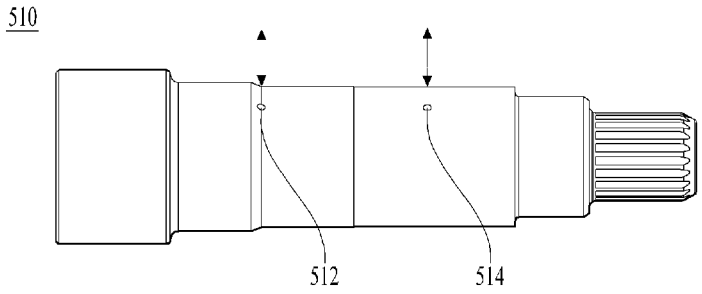
FIG. 16 is a diagram illustrating an example of a rotary shaft.
Figure 17:
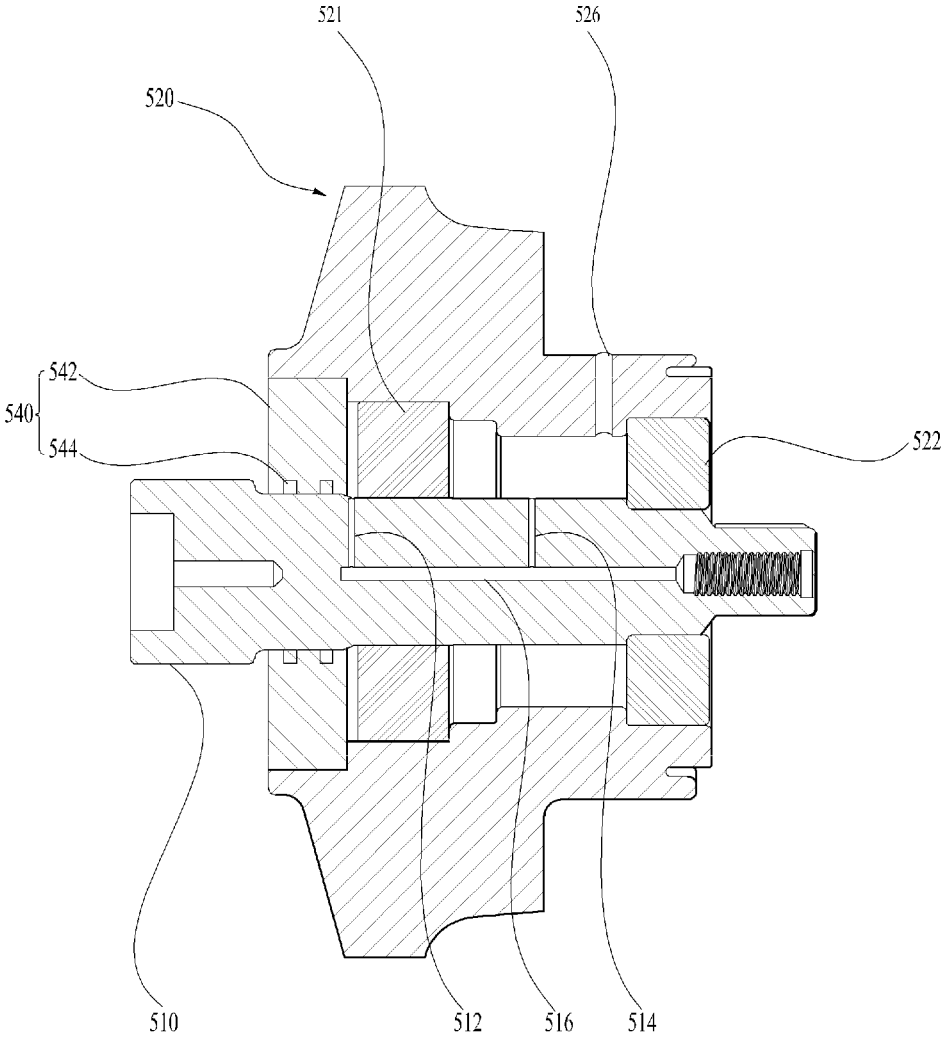
FIG. 17 is a diagram illustrating an exemplary state in which the rotary shaft of FIG. 16 is coupled to other elements.

FIG. 16 is a diagram illustrating an example of a rotary shaft. FIG. 17 is a diagram illustrating an exemplary state in which the rotary shaft of FIG. 16 is coupled to other elements.

A rotary shaft 510 having one side coupled to the drum 350 and the other side coupled to the rotor 550 can be provided at the center of the bearing housing 520. The rotary shaft 510 can be disposed to pass through the center of the bearing housing 520.

The rotary shaft 510 can be supported by the bearing housing 520 through the first bearing 521 and the second bearing 522. The rotary shaft 510 can be supported to be rotatable by the two bearings. In this case, the two bearings can be implemented as various shapes of bearings as long as they are rotatably supported components.

In some implementations, the first bearing 521 and the second bearing 522 can have different sizes, so that the first bearing 521 and the second bearing 522 can stably support the rotary shaft 510. On the other hand, the shape of the rotary shaft 510 corresponding to a portion supported by the first bearing 521 can be formed differently from the shape of the rotary shaft 510 corresponding to a portion supported by the second bearing 522 as needed.

In some implementations, a sealing part 540 can be provided at one side of the first bearing 521. The sealing part 540 can be disposed along the circumferential surface of the rotary shaft 510. The sealing part 540 can be exposed to the space formed by the first housing 100 and the barrier 400, so that carbon dioxide can be prevented from moving through a gap between the rotary shaft 510 and the bearing housing 520. Specifically, the sealing part 540 can prevent liquid carbon dioxide from moving into the space opposite to the barrier 400.

The sealing part 540 can include a shaft-seal housing 542 that is disposed between the rotary shaft 510 and a hole through which the rotary shaft 510 passes, so that the shaft-seal housing 542 can seal a gap between the rotary shaft 510 and the hole. A shaft seal 544 can be disposed at a portion where the shaft-seal housing 542 and the rotary shaft 510 meet each other, thereby improving sealing force. The shaft seal 544 can be disposed to surround the circumferential surface of the rotary shaft 510.

The bearing housing 520 can include a communication hole 526 through which inflow or outflow of external air is possible. The communication hole 526 of the bearing housing 520 can be exposed to the space partitioned by the second housing 200 and the barrier 400.

The rotary shaft 510 can be provided with a first flow passage 512 and a second flow passage 514 spaced apart from each other such that inflow or outflow of air is possible through the first flow passage 512 and the second flow passage 514. For example, the first flow passage 512 and the second flow passage 514 can be formed in a radial direction from the center of the rotary shaft 510.

Air in the space partitioned by the second housing 200 and the barrier 400 can flow into the rotary shaft 510 through the first flow passage 512 and the second flow passage 514.

In particular, a connection flow passage 516 for connecting the first flow passage 512 to the second flow passage 514 can be formed. The connection flow passage 516 can be disposed at the center of rotation of the rotary shaft 510, and can be vertically connected to each of the first flow passage 512 and the second flow passage 514.

If the connection flow passage 516 does not exist, each of the first flow passage 512 and the second flow passage 514 is perforated on the outer surface of the rotary shaft 510, but the opposite side of each of the first flow passage 512 and the second flow passage 514 is closed. Therefore, it is difficult for air to substantially flow into the first flow passage 512 or the second flow passage 514. To this end, the connection flow passage 516 for interconnecting two flow passages can be formed. Thus, when the internal pressure of the rotary shaft 510 is changed, air can more easily flow into the first flow passage 512, the second flow passage 514, and the connection flow passage 516, so that pressure of the rotary shaft 510 can be maintained in the same manner as the external pressure change.

The rotary shaft 510 can rotate in a state in which one side of the rotary shaft 510 is fixed to the drum 350 and the other side of the rotary shaft 510 is fixed to the rotor 550. Therefore, noise or vibration can occur in the rotary shaft 510. If the rotary shaft 510 rotates at a place where there occurs a pressure deviation, noise or vibration can unavoidably increase. Therefore, the rotary shaft 510 can include a communication hole 526 through which air can flow into the bearing housing 520. The bearing housing 520 is a relatively large-sized component and has a space for allowing air to enter and circulate therein, so that air can be introduced without distinction between the air inlet and the air outlet. On the other hand, the rotary shaft 510 can be made of a material having high rigidity, but the strength of the rotary shaft 510 is reduced so that it is difficult to secure the space in which air can easily flow, thereby increasing the size of the air passage. Therefore, the plurality of flow passages can be coupled to each other, resulting in formation of a path through which the introduced air can be discharged through the opposite flow passage.

In some examples, the washing chamber 10 can be coupled to the first housing 100 and the second housing 200, resulting in formation of a sealed space. For example, the sealed space can be divided into two spaces by the barrier 400. Based on the barrier 400, one space can be a space for laundry treatment, and the other space can be a space for installation of the motor or the like.

Figure 18:
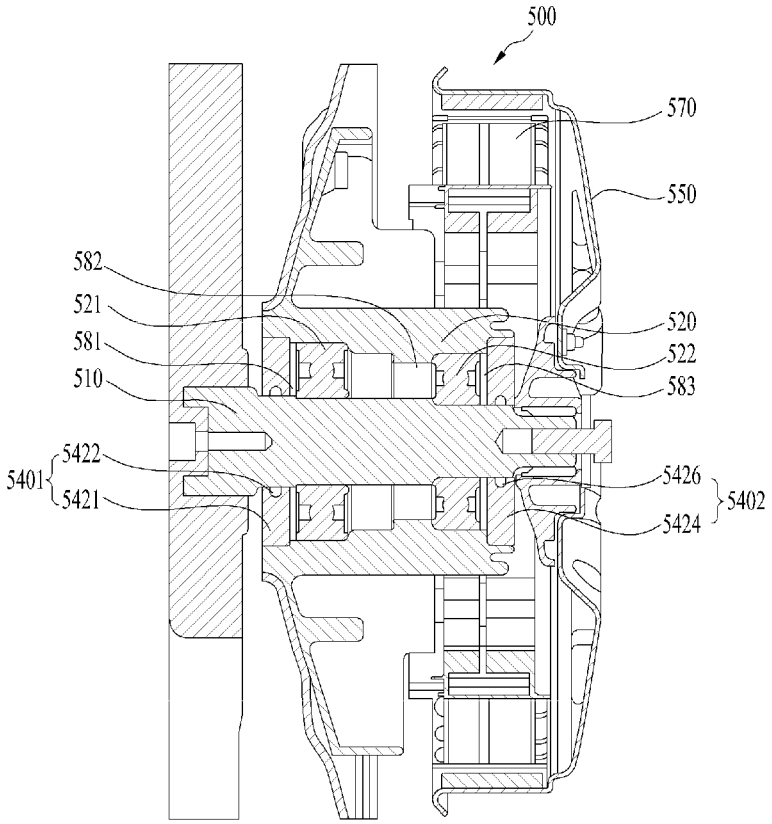
FIGS. 18-21 are diagrams illustrating examples of a rotary shaft.

FIG. 18 is a diagram illustrating an example of a rotary shaft. The following implementation will hereinafter be described with reference to FIG. 18. The implementation shown in FIG. 18 will hereinafter be described centering upon some parts different from those of FIG. 17, and the same parts as those of FIG. 17 will herein be omitted for convenience of description.

The bearing housing 520 disposed in the motor assembly 500 can include a first sealing part 5401 and a second sealing part 5402 coupled to the rotary shaft 510. The first sealing part 5401 and the second sealing part 5402 can be spaced apart from each other A shaft seal can be disposed in the first sealing part or the second sealing part 5402, so that a portion of the rotary shaft is not exposed by the first sealing part 5401 and the second sealing part 5402. For example, the shaft seal is in contact with the rotary shaft, so that external carbon dioxide is not introduced between the shaft seal and the rotary shaft. Accordingly, inflow and outflow of carbon dioxide are difficult in a portion in which the rotary shaft is disposed between the first sealing part and the second sealing part. Therefore, the shaft seal can be implemented as a plurality of shaft seals.

The first sealing part 5401 can include a shaft-seal housing 5421 and a shaft seal 5422 disposed in the shaft-seal housing 5421. For example, the shaft seal 5422 can have a ring shape surrounding a first portion of an outer circumferential surface of the rotary shaft 510.

The second sealing part 5402 can include a shaft-seal housing 5424 and a shaft seal 5426 disposed in the shaft-seal housing 5424. For example, the shaft seal 5426 can have a ring shape surrounding a second portion the outer circumference of the rotary shaft 510. In some examples, a diameter of the first sealing part 5401 can be greater than or equal to a diameter of the second sealing part 5402.

As can be seen from FIG. 18, one shaft seal can be disposed in each of the first sealing part and the second sealing part, so that two shaft seals of the first and second sealing parts can be in contact with the rotary shaft.

A first bearing 521 and a second bearing 522 for rotatably supporting the rotary shaft can be disposed between the first sealing part 5401 and the second sealing part 5402. The rotary shaft can be rotatably supported by two bearings, and the two bearings can be disposed between the two sealing parts.

The structure shown in FIG. 18 can include a first space 581 partitioned by the first sealing part 5401, the rotary shaft 510, the first bearing 521, and the bearing housing 520; a second space 582 partitioned by the first bearing 521, the rotary shaft 510, the second bearing 522, and the bearing housing 520; and a third space 583 partitioned by the second bearing 522, the rotary shaft 510, the second sealing part 5402, and the bearing housing 520.

The sealing part and the bearing can be formed in a doughnut shape, and the rotary shaft 510 can be disposed at the center of the doughnut shape. The circumferential surfaces of the sealing part and the bearing can be disposed in the bearing housing 520, so that a space sealed with a predetermined pressure level by sealing parts 5401 and 5402, the rotary shaft 510, and the bearing housing 520 is partitioned.

Therefore, external air such as carbon dioxide can be blocked from a portion where the rotary shaft 510 and the bearings 521 and 522 are in contact with each other. Thus, carbon dioxide to be used for washing in the corresponding space can be blocked from flowing into or out of the corresponding space, so that consumption of lubricant can also be reduced or prevented.

Figure 19:
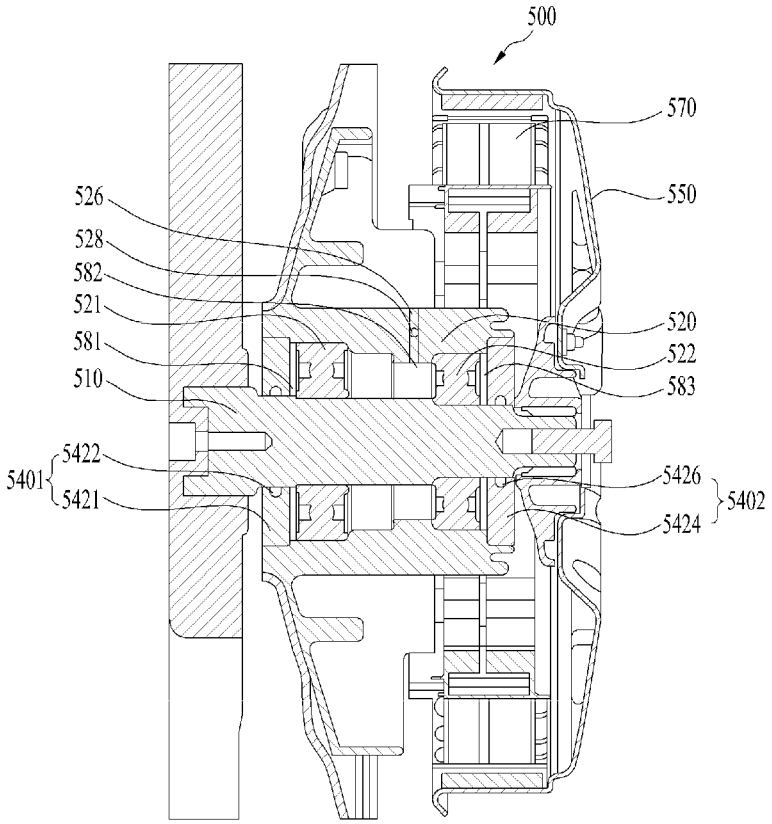

FIG. 19 is a diagram illustrating an example of a rotary shaft. The following implementation will hereinafter be described with reference to FIG. 19. The implementation shown in FIG. 19 will hereinafter be described centering upon some parts different from the above-described implementations, and the same parts as those of the above-described implementations will herein be omitted for convenience of description.

The bearing housing 520 can include a communication hole 526 through which external air can flow into or out of the second space 582. The communication hole 526 can form a path through which air can move from the outside of the bearing housing to the second space 582.

In some examples, a check valve 528 can be disposed in the communication hole 526. Whereas the check valve 528 guides air to flow into the second space 582, the check valve 528 can prevent air from being discharged from the second space 582. Therefore, in a situation where the external pressure is relatively high, air can flow into the second space 582, resulting in formation of pressure equilibrium between two spaces partitioned by the check valve 528. In a situation, where pressure of the external space is lowered, the air in the second space 582 may not move to the external space, so that the second space can be maintained at constant pressure. Accordingly, even when the pressure of the washing tub is changed while washing is performed, pressure of the driving system is maintained constant, so that the driving system can be prevented from excessively operating.

A chamber in which the bearing is disposed can receive the pressure formed in the housing of the washing tub through the check valve, so that the same pressure as in the washing-tub housing is formed in the chamber. The chamber can be configured to have almost no pressure leakage by the check valve having one-way characteristics and the shaft seal. Therefore, while the washing machine operates, compression and decompression of the washing tub can be repeatedly performed, but the pressure in the chamber in which the bearing is disposed is almost unchanged, so that leakage of grease for the lubrication function of the bearing can be minimized, thereby providing a driving system with long-term reliability.

Figure 20:
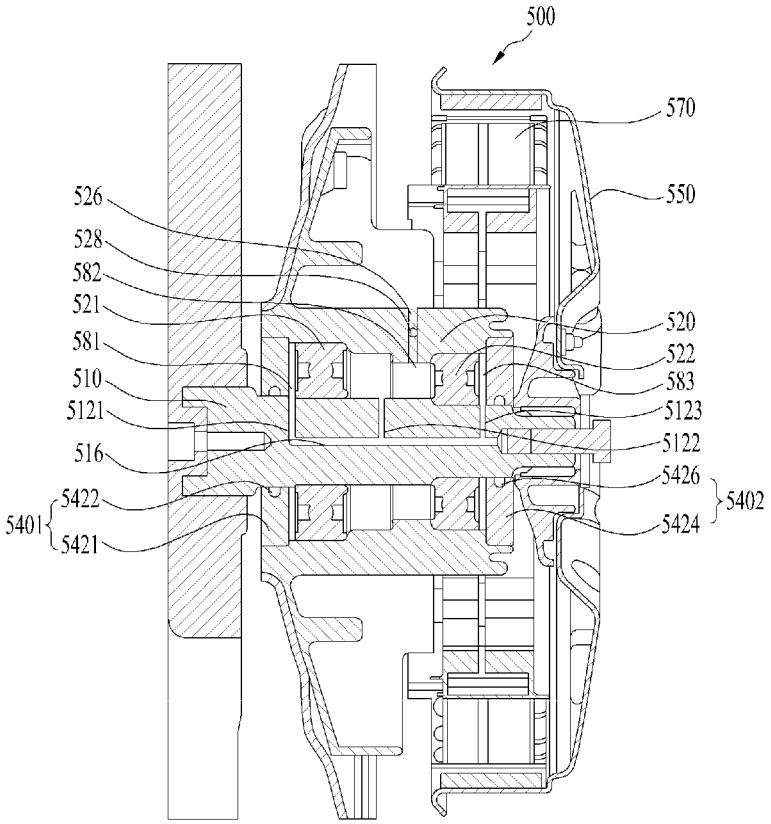

FIG. 20 is a diagram illustrating an example of a rotary shaft. The following implementation will hereinafter be described with reference to FIG. 20. The implementation shown in FIG. 20 will hereinafter be described centering upon some parts different from the above-described implementations, and the same parts as those of the above-described implementations will herein be omitted for convenience of description.

In some implementations, the rotary shaft 510 can include a second flow passage 5122 for connecting the second space 582 to the center of the rotary shaft 510. In some examples, the rotary shaft can include a connection flow passage 516 that is disposed at a center of rotation and extends along a center axis of rotation. The rotary shaft can include a first flow passage 5121 for connecting the connection flow passage to the first space 581. The rotary shaft can include a third flow passage 5123 for connecting the connection flow passage 516 to the third space 583.

The first flow passage 5121, the second flow passage 5122, the third flow passage 5123, and the connection flow passage 516 can be coupled to each other, so that the first space, the second space, and the third space can be maintained at the same pressure. Therefore, since the pressure inside the driving system can be maintained at the same pressure, occurrence of damage caused by pressure imbalance can be prevented during rotation of the rotary shaft 510.

Although pressure in the washing chamber is changed while washing is performed, the first space, the second space, and the third space are maintained at the same pressure, there is no change in pressure. Thus, occurrence of vibration or noise can be prevented when the motor is driven.

Figure 21:
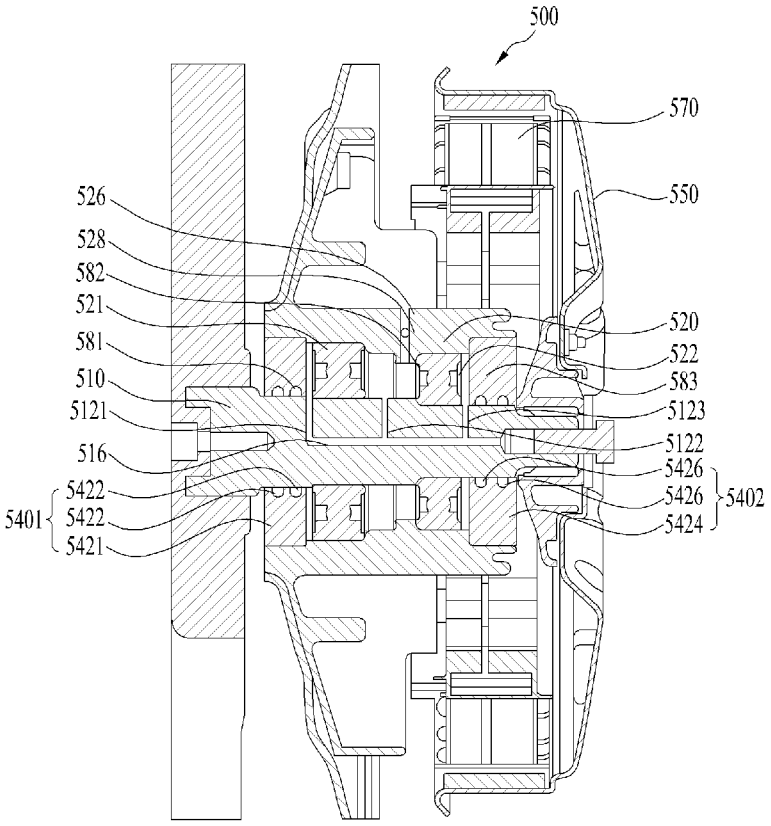

FIG. 21 is a diagram illustrating an example of a rotary shaft. The following implementation will hereinafter be described with reference to FIG. 21. The implementation shown in FIG. 21 will hereinafter be described centering upon some parts different from the above-described implementations, and the same parts as those of the above-described implementations will herein be omitted for convenience of description.

In the implementation of FIG. 21, two shaft seals 5422 can be disposed in the first sealing part 5401. In addition, two shaft seals 5426 can be disposed in the second sealing part 5402. As a result, by the above-described two sealing parts, carbon dioxide can be prevented from moving to the bearing.

As described above, the present disclosure provides one or more example structures for helping to prevent carbon dioxide from penetrating into the bearing for rotating the rotary shaft.

In addition, the washing machine can reduce or prevent a change in pressure from being transferred to the driving system when pressure is changed in the washing machine.

The washing machine can reduce the amount of carbon dioxide to be used so that the amount of residual carbon dioxide to be reprocessed after use can also be reduced, resulting in improvement in energy efficiency of the entire system. In addition, since the amount of carbon dioxide to be used is reduced, the size of a storage tank that stores carbon dioxide before use can also be reduced, so that the overall size of the washing machine can be reduced.

In particular, the amount of carbon dioxide to be used in the washing machine can be reduced as compared to the prior art, so that the amount of carbon dioxide to be reprocessed after use can also be reduced. As the amount of carbon dioxide to be used is reduced, the overall size of the washing machine for using carbon dioxide as well as the capacity of a storage tank storing carbon dioxide can be reduced. In addition, since the amount of carbon dioxide to be reprocessed after use is reduced, the time for washing or rinsing can also be reduced.

In some implementations, the washing machine is configured in a manner that various elements can be separated from the washing machine so that an operator (or a repairman) can easily access and repair a component from among the elements. In addition, the washing machine provides a structure in which various elements can be combined to produce an actual product, so that the operator can easily manufacture the washing machine designed to use carbon dioxide.

In some implementations, a stator and a rotor are disposed together around a rotary shaft configured to rotate the drum, and the space to be occupied by a motor assembly is reduced in size, so that the overall size of the washing machine can also be reduced. In addition, the coupling relationship of the elements for rotating the drum is simplified, so that noise generated by rotation of the drum can be reduced and the efficiency of power transmission can increase.

In some implementations, whereas liquid carbon dioxide is not introduced into the driving space in which the motor is disposed, gaseous carbon dioxide can flow into the driving space, and the drum can be rotated in a state in which pressure equilibrium between the washing space and the driving space is maintained. Therefore, when the washing machine operates, the drum can stably rotate. In addition, since the driving space is filled with gaseous carbon dioxide, the amount of carbon dioxide to be used for laundry treatment such as washing can be reduced.

It will be apparent to those skilled in the art that the present disclosure can be implemented in other specific forms without departing from the spirit and essential characteristics of the disclosure. Thus, the above implementations are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A washing machine comprising:

a first housing that defines an inner space and an opening;

a drum disposed in the inner space of the first housing and configured to accommodate laundry, the washing machine being configured to perform washing using carbon dioxide supplied into the drum;

a barrier that covers the opening of the first housing and is coupled to the first housing;

a second housing that covers a surface of the barrier and is coupled to the first housing; and a motor assembly coupled to the barrier, the motor assembly comprising:

a stator, a rotor configured to rotate the drum, a bearing housing, a rotary shaft disposed in the bearing housing, the rotary shaft having a first end coupled to the rotor and a second end coupled to the drum, and a first sealing part and a second sealing part that are disposed in the bearing housing and coupled to the rotary shaft.

2. The washing machine according to claim 1, wherein the first sealing part and the second sealing part are spaced apart from each other in an axial direction of the rotary shaft.

3. The washing machine according to claim 2, wherein at least one of the first sealing part or the second sealing part comprises a shaft seal that contacts and surrounds an outer circumferential surface of the rotary shaft.

4. The washing machine according to claim 2, wherein at least one of the first sealing part or the second sealing part comprises a plurality of shaft seals that contact and surround an outer circumferential surface of the rotary shaft.

5. The washing machine according to claim 2, wherein the motor assembly further comprises a first bearing and a second bearing that are disposed between the first sealing part and the second sealing part and rotatably support the rotary shaft.

6. The washing machine according to claim 5, wherein the first sealing part, the first bearing, the second bearing, and the second sealing part partition an inner space of the bearing housing into a plurality of spaces, the plurality of spaces comprising:

a first space that is defined by the first sealing part, the rotary shaft, the first bearing, and the bearing housing;

a second space that is defined by the first bearing, the rotary shaft, the second bearing, and the bearing housing; and a third space that is defined by the second bearing, the rotary shaft, the second sealing part, and the bearing housing.

7. The washing machine according to claim 6, wherein the bearing housing defines a communication hole configured to introduce air into the second space or discharge air out of the second space.

8. The washing machine according to claim 7, wherein the motor assembly further comprises a check valve disposed in the communication hole.

9. The washing machine according to claim 7, wherein the rotary shaft defines a flow passage that connects the second space to a center portion of the rotary shaft.

10. The washing machine according to claim 9, wherein the rotary shaft further defines a connection flow passage at the center portion of the rotary shaft, the connection flow passage extending along the axial direction of the rotary shaft.

11. The washing machine according to claim 10, wherein the rotary shaft further defines a first flow passage that connects the connection flow passage to the first space, and wherein the flow passage is a second flow passage of the rotary shaft that connects the connection flow passage to the second space.

12. The washing machine according to claim 11, wherein the rotary shaft further defines a third flow passage that connects the connection flow passage to the third space.

13. The washing machine according to claim 7, wherein the rotary shaft defines a plurality of flow passages comprising:

a connection flow passage that passes through an inside of the rotary shaft along a rotation axis of the rotary shaft.

14. The washing machine according to claim 13, wherein the plurality of flow passages further comprise:

a first flow passage that radially extends from the connection flow passage to the first space;

a second flow passage of the rotary shaft that radially extends from the connection flow passage to the second space; and a third flow passage that radially extends from the connection flow passage to the third space.

15. The washing machine according to claim 14, wherein the plurality of flow passages are configured to communicate air to thereby maintain an equal pressure in the first space, the second space, and the third space.

16. The washing machine according to claim 1, wherein the barrier defines (i) a first housing space between the first housing and the barrier and (ii) a second housing space between the second housing and the barrier, the barrier being configured to block liquid carbon dioxide injected into the first housing space from leaking into the second housing space.

17. The washing machine according to claim 16, wherein the motor assembly passes through the barrier and is disposed in the first housing space and the second housing space.

18. The washing machine according to claim 16, wherein the rotor is disposed in the second housing space, and the rotary shaft extends from the first housing space to the second housing space through the barrier.

19. The washing machine according to claim 1, wherein the first sealing part comprises a first sealing ring that surrounds a first portion of an outer circumferential surface of the rotary shaft, and wherein the second sealing part comprises a second sealing ring that is spaced apart from the first sealing ring in an axial direction of the rotary shaft and surrounds a second portion of the outer circumferential surface of the rotary shaft.

20. The washing machine according to claim 19, wherein the first sealing part further comprises a first shaft-seal housing that accommodates the first sealing ring, wherein the second sealing part further comprises a second shaft-seal housing that accommodates the second sealing ring, and wherein each of the first shaft-seal housing and the second shaft-seal housing radially extends to an inner surface of the bearing housing and is in contact with the rotary shaft and the inner surface of the bearing housing.

* * * * *